US006830680B2

(12) United States Patent
Queirel

(10) Patent No.: US 6,830,680 B2
(45) Date of Patent: Dec. 14, 2004

(54) FILTERING METHOD FOR SWIMMING POOLS WITH WATER FLOW RATE MULTIPLYING UNIT

(76) Inventor: Joel Queirel, 39, rue Jules Lebocey 10000, Troyes (FR)

( * ) Notice: Subject to any disclaimer, the term of this patent is extended or adjusted under 35 U.S.C. 154(b) by 69 days.

(21) Appl. No.: 10/311,067

(22) PCT Filed: Apr. 22, 2002

(86) PCT No.: PCT/FR02/01370

§ 371 (c)(1),
(2), (4) Date: Dec. 13, 2002

(87) PCT Pub. No.: WO02/086259

PCT Pub. Date: Oct. 31, 2002

(65) Prior Publication Data

US 2003/0141232 A1 Jul. 31, 2003

(30) Foreign Application Priority Data

Apr. 25, 2001 (FR) ..... 01 05556

(51) Int. Cl.[7] ..... E04H 4/12

(52) U.S. Cl. ..... 210/169; 210/416.2; 210/805; 137/602

(58) Field of Search ..... 210/169, 416.1, 210/416.2, 448, 805; 137/602, 888; 417/65

(56) References Cited

U.S. PATENT DOCUMENTS 2,247,116 A * 6/1941 Day ..... 210/169
3,304,564 A * 2/1967 Green et al. ..... 15/1.7
3,552,568 A * 1/1971 Wade ..... 210/169
3,756,220 A * 9/1973 Tehrani et al. ..... 210/169
4,501,659 A 2/1985 Henk
4,826,591 A 5/1989 Macia
5,238,585 A * 8/1993 Reed, Sr. ..... 210/805
5,695,654 A * 12/1997 Schultz ..... 210/780
5,785,846 A 7/1998 Barnes et al.
5,893,641 A * 4/1999 Garcia ..... 366/163.2
6,609,374 B2 * 8/2003 Feucht et al. ..... 60/602

FOREIGN PATENT DOCUMENTS

FR 2710363 A1 3/1995

* cited by examiner

*Primary Examiner*—Fred G. Prince
(74) *Attorney, Agent, or Firm*—Rothwell, Figg, Ernst & Manbeck

(57) ABSTRACT

This invention relates to a filtration process for swimming pools, to a water flow multiplier for the implementation of this process and to the swimming pools thus designed.

According to this invention, at least a portion of the return water flow of the circulation pump (10) is sent in at least one flow multiplier (30), consisting essentially of a convergent tuyere followed by a divergent tuyere with, at the intermediary location, an admission (29) of said return water flow of the pump, of which the entrance on the side of the convergent tuyere communicates with at least one admission (23) of the water to be filtered coming from the swimming pool and which goes through a filter (31) suitably set upstream from this entrance, and of which the exit on the side of the divergent tuyere opens to the pool forming return (33).

9 Claims, 6 Drawing Sheets

Related Art

FILTERING METHOD FOR SWIMMING POOLS WITH WATER FLOW RATE MULTIPLYING UNIT

This invention relates to a filtration process for swimming pools enabling to considerably improve the effectiveness of the filtration by increasing the flow of filtered water without increasing the power of the pumps needed for the water circulation.

Conversely, it is possible, by using pumps of reduced power, to maintain the same filtration quality than obtained with higher-powered pumps.

According to the U.S. Pat. No. 4,501,659, an approach has attempted to use the pump return or discharge flow, i.e. the water returned to the pool after filtration, to increase the suction rate of the water admitted into an added basket acting as what is known as a surface skimmer or "skimmer." This approach, illustrated in particular in FIG. 7 of this patent, and sketched in FIG. 8 of this request, uses the effect known as "Venturi" to send the pump return flow through a tubing 117 that opens by a nozzle 119 in a port 124 at the base of the receptacle 113 which the pool water enters through an opening 114. The water return from the circulation pump, if it takes place for instance under a flow of 10 $m^3$ will generate, as it drives the water stream, an output flow of 25 $m^3$ for instance as it exits the port 124. These 15 $m^3$ are thus sucked through the opening 114, instead of the 10 $m^3$ only that would be obtained if all the pump return water had to be replenished though the opening 114. Not only is the inflow increase not actually significant, but this device is inconvenient to use because it does not in particular enable to select the best locations for the return and the suction which will necessarily be superimposed. Moreover, this document does not address an actual water filtration, but only the gathering in the basket 134 of the biggest particles such as leaves that may float on the water. FIG. 9 will help to better understand the operating principle of this patent. FIG. 9 shows the diagram of the overall system lay-out, supposing for instance that the water suction is performed by a pump 10, at the level of a bottom plug 11, via a filter 12, with the return in 13 (corresponding to the opening 124 of FIG. 8) and the suction in 14, right above (corresponding to the admission opening 114) for the recycling in that part of the pool of a water stream going through the basket 134.

Contrary to the abovementioned document approach, this invention uses at least some of the return water flow of the circulation pump to send it in at least one flow multiplier, consisting essentially of a convergent tuyere followed by a divergent tuyere with, at the intermediary location, an admission for said pump return water flow, the entrance on the side of said convergent tuyere of the flow multiplier communicating with at least one admission for the water to be filtered that comes from the swimming pool and goes through a filter suitably set upstream from this admission; meanwhile, the exit on the side of the divergent tuyere opens to the return pool.

Not only is the flow multiplier of this invention markedly more effective, as shown more clearly in the following description, than the nozzle driver of the document U.S. Pat. No. 4,501,659, but in addition the process of this invention enables to filter the total multiplied water flow and, besides, to feedback the return water with its multiplied flow to any suitable pool location.

According to another characteristic of this invention, the admission of the water to be filtered can be advantageously performed by means of at least one skimmer.

The invention also relates to a water flow multiplier, characterized in that it consists of:

on the suction side a convergent tuyere;

on the return side a divergent tuyere;

at the neck level, between the two connecting tuyeres, a ring around the narrower section, said ring receiving the pump return water that comes through an annular slit to the beginning of the divergent tuyere.

This invention also relates, of course, to a swimming pool equipped with a filtration system designed according to this process or equipped with a flow multiplier according to this invention.

The invention and its implementation will appear more clearly from the following description in reference to the accompanying drawings.

In these drawings:

FIGS. 1 and 2 illustrate a standard diagram for the filtration and circulation of a standard family swimming pool that can, for instance, be 5-m. wide and 10-m. long with, at one end stairs to access the pool in a low-depth zone and, on the opposite side, a deeper diving zone equipped with, at its center and on its bottom, a bottom plug.

Figure 1:
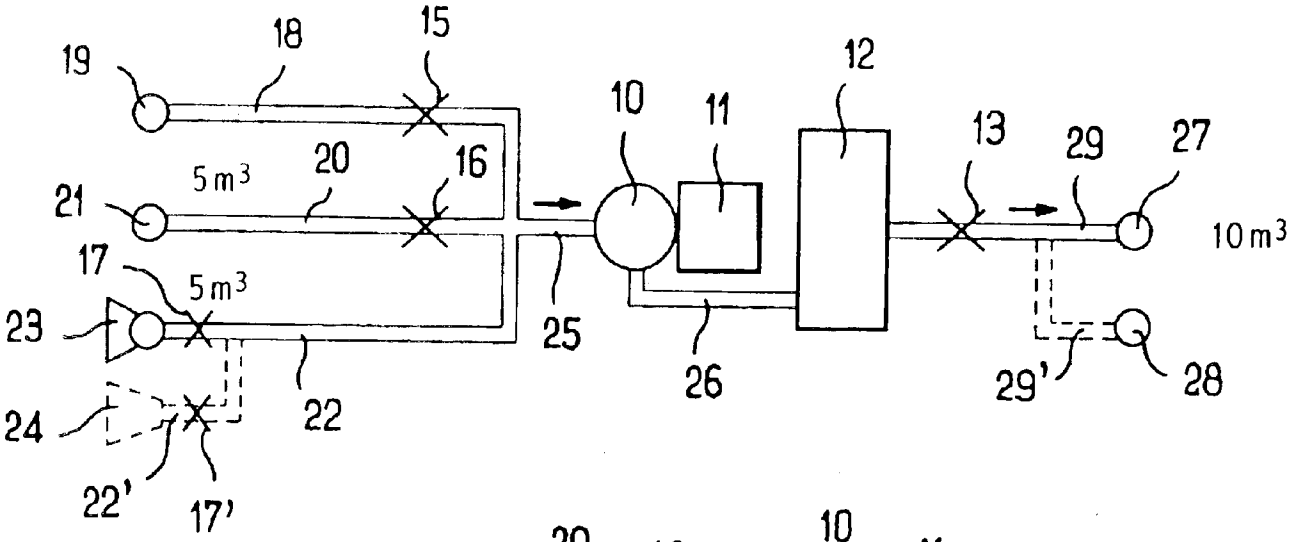
FIG. 1 is a diagram of a standard circuit for the filtration and circulation of the water of a swimming pool.

In these drawings are shown in 10 a pump chamber driven by an electric motor 11, in 12 a filter, either a sand filter or a cartridge filter, in 13, 15, 16, 17 and 17' various valves for the opening and sealing of the tubings on which these valves are set. A tubing 18 leads to a brush plug 19, 20 represents a tubing that leads to the bottom plug 21, and a tubing 22 leads to a skimmer 23 or else two tubings 22, 22' lead to two skimmers 23, 24. All these tubings are connected through the valves 15, 16, 17 and 17' to a tubing 25 that communicates with the suction side of the pump 10. On the return side, the pump 10 sends the water to be filtered through a tubing 26 to the filter 12, the filtered water being returned through the valve 13 leading to a return nozzle 27 or, more usually, two tubings 29, 29' leading to two return nozzles 27, 28.

Supposing for instance that the flow of the pump 10 is 10 $m^3/h$ (indicated hereafter simply as 10 $m^3$) under a pressure of about 1 bar, which is the case for a standard pump, the suction and return flows are such as indicated in the diagrams, i.e. in the case of two returns at the nozzles 27, 28 and three suctions at the bottom plug 21 and the skimmers 23, 24, respectively, the return flow will be 5 $m^3$ at each nozzle 27, 28, the suction flow will be for instance 5 $m^3$ at the bottom plug 21, and the two suction flows will be 2, 5 $m^3$ at the two skimmers 23 and 24.

If it is desired to use the brush which is plugged in the plug 19, the suction valves 16, 17 and 17' are closed and the brush valve 15 is opened. A 10 $m^3$ suction flow (the flow of the pump 10) is thus obtained for the use of the brush under the most efficient conditions.

Figure 3:
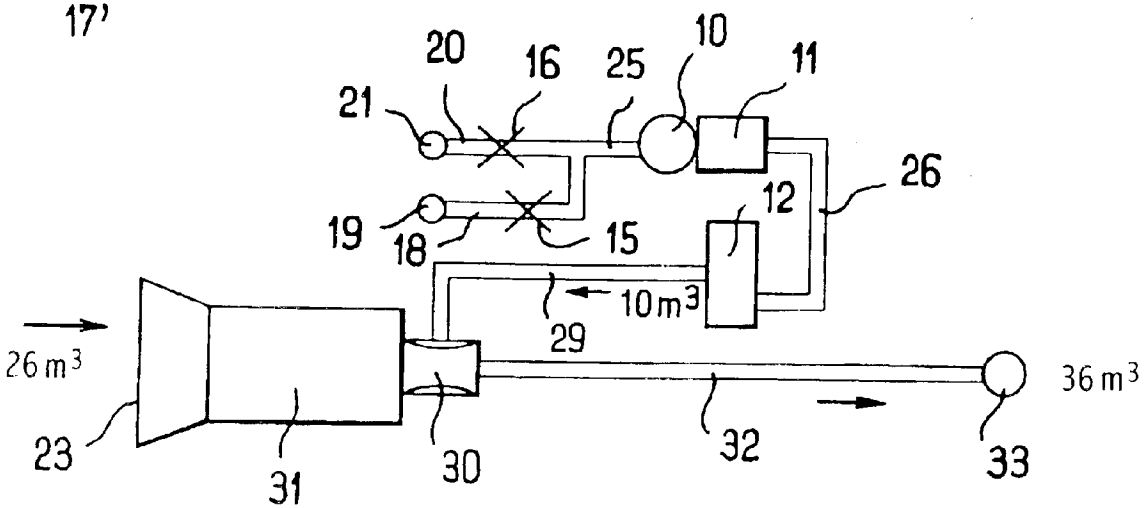
FIG. 3 shows, as in FIG. 1, a water filtration and circulation circuit of a swimming pool modified according to this invention.
Figure 2:
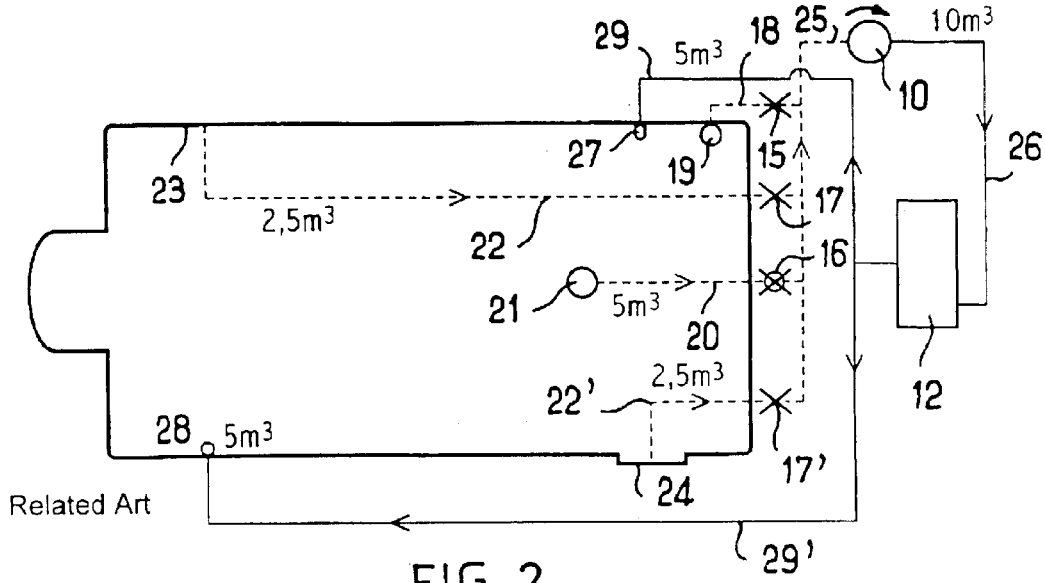
FIG. 2 is a top view of the pool equipped with the filtration and circulation circuit shown in FIG. 1.
Figure 4:
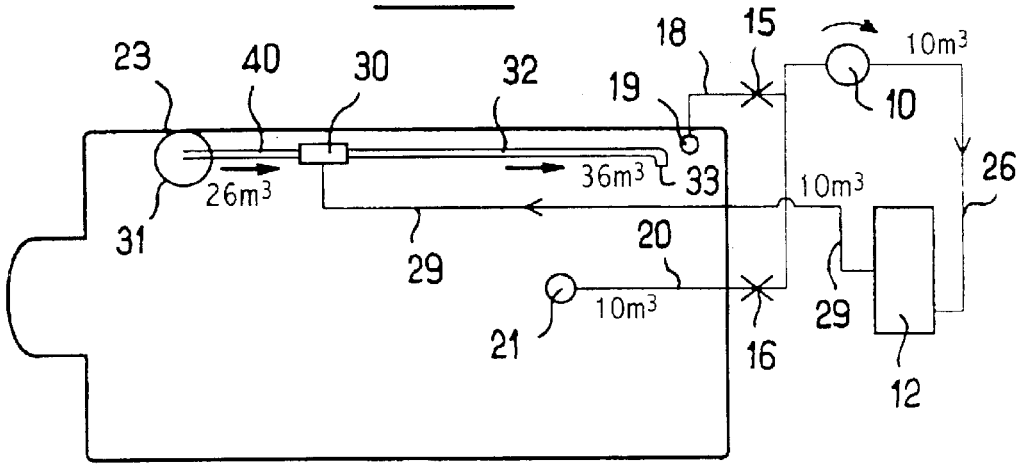
FIG. 4 is a top view of the pool equipped with the filtration and circulation circuit of FIG. 3.

Referring now to the diagrams of FIGS. 3 and 4 in which the references of FIGS. 1 and 2 are applied to similar elements in the two set-ups. Here again we have the pump 10 with its motor unit 11, the filter 12, the tubing 20 connecting to the bottom plug 21, the tubing 18 connecting to the brush plug 19, and the valves 15 and 16 provided in the tubings 18 and 20.

Contrary to the standard set-up diagrams, the return water coming out of the filter 12 via the tubing 29 is not sent to a return nozzle in the swimming pool. This filtered water flow (10 $m^3$ in the example chosen for the pump 10) is sent to a flow multiplier specifically designed to achieve the goals of this invention. The engineering of said flow multiplier will be detailed herafter in reference to FIG. 7.

In brief, this flow multiplier shown as a whole in 30 consists in the end-to-end assembly of two tuyeres respectively convergent at the entrance and divergent at the exit (according to the direction of the water circulation through the tuyeres) and of a ring set at the level of the communication neck of the two tuyeres and surrounding this narrower section. Through said ring is brought the return water of the pump that comes through an annular slit to the beginning of the divergent tuyere.

This flow multiplier thus produces a suction in the admission tuyere (the convergent tuyere) under a flow multiplied by a factor comprised between 2 and 3, most precisely 2, 6 in the example illustrated and implemented here. Thus, when a 10 $m^3$ flow is admitted in the flow acceleration ring, it is a 26 $m^3$ flow that is sucked at the entrance of the device, and a 36 $m^3$ that is discharged at the exit.

According to this invention, this arrangement is advantageous when the entrance on the convergent tuyere side of the multiplier 30 communicates with at least one admission for the water to be filtered coming from the swimming pool and that will be sent to a filter suitably set upstream from said entrance, while the exit on the divergent tuyere side will lead to the return pool at the most suitable location for the best circulation of the pool water. In the illustrated example that constitutes a perfectly suitable embodiment, the admission of the water to be filtered is performed by a skimmer mouth. The mouth of the skimmer 23 is thus shown in the diagrams of FIGS. 3 and 4.

However, contrary to a standard skimmer mouth, a filter 31, for instance a cartridge filter, is set right downstream from the mouth 23. The set-up of this filter in the swimming pool is detailed hereafter in FIG. 5. It enables the installation to filter not only the 10 $m^3$ of water coming through the tubing 26 to the filter 12, but also an additional 26 $m^3$ coming via the skimmer 23 and going through the filter 31. Simultaneously, the exit of the device forming flow multiplier opens to a conduit 32 of suitable diameter that ends with a return nozzle 33 set in the pool in a location suitable for achieving the best circulation of the pool water.

The installation of the multiplying device allows, of course, for a broad range of possible variations. As shown for example in FIG. 6, the 36 $m^3$ of water flow returned at the exit of the multiplier can be sent, as in the standard set-up diagram of FIG. 2, to two nozzles such as 27 and 28 but which will receive each a flow of 18 $m^3$ instead of the 5 $m^3$ obtained in the standard diagram with a pump of the same power. And likewise, the suction in the multiplier can be implemented via the two skimmers 23 and 24 of the set-up of FIG. 2, but with a suction flow of 13 $m^3$ instead of the 2.5 $m^3$ obtained with the standard diagram. Moreover, both skimmers 23 and 24 will be advantageously equipped with a filter, of the type described hereafter in FIG. 5, for instance.

Figure 6:
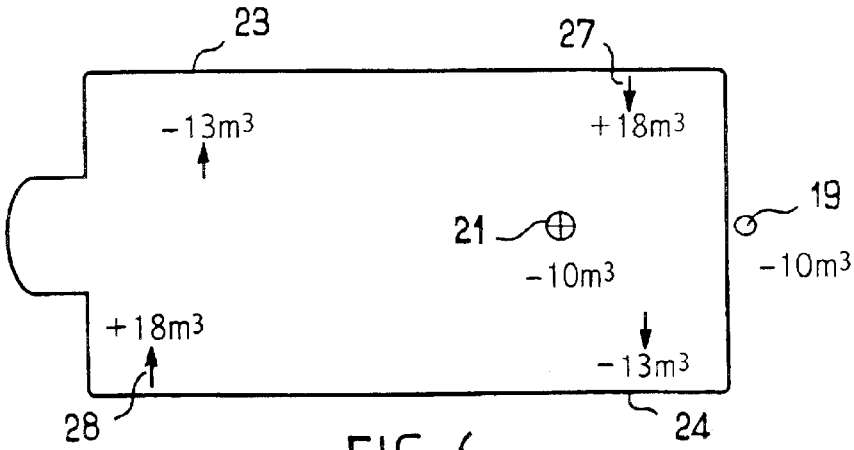
FIG. 6 is a top view of a swimming pool equipped as in FIG.4, but with a slightly different arrangement concerning the system suction and return flows.

A comparison between the diagrams in FIGS. 2 and 6 readily shows the considerable advantages obtained when using the perfected device of this invention; it allows to greatly increase, for a constant motor power, the flow of filtered water and the efficiency of the pool water circulation. Conversely, it is possible to decrease the motor power to obtain, by using the flow multiplier of this invention, a filtration as effective as it would be with a standard installation equipped with a more powerful motor.

The resulting advantages are thus the level of power consumption needed to drive the motor, the consumption level of the products needed to maintain the quality of the swimming-pool water, the efficiency of the water circulation and in particular a much more efficient cleaning of the surface water.

Figure 5:
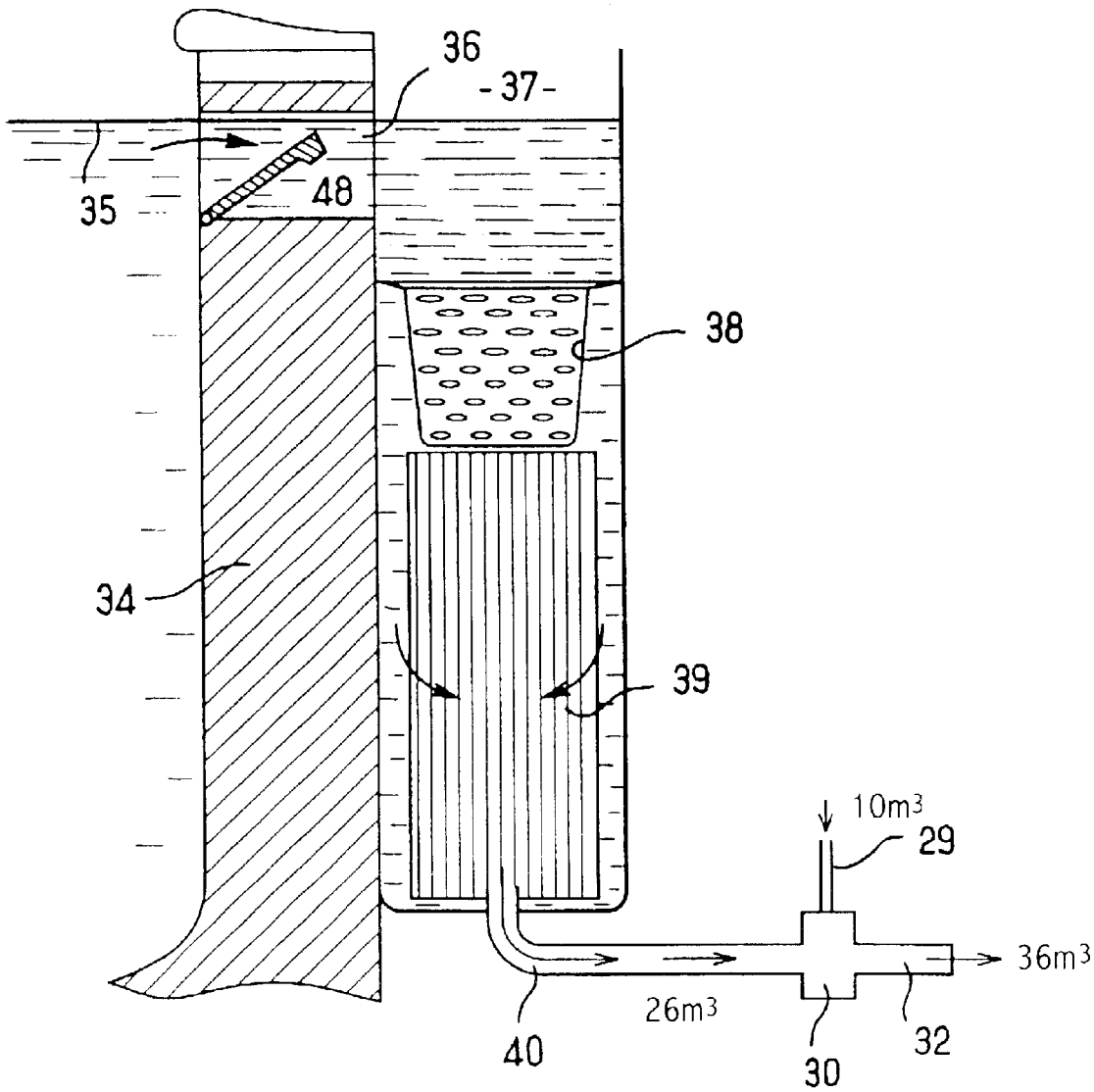
FIG. 5 is a cross-section view of a filtration system according to this invention with an admission for the water to be filtered set at the mouth of a skimmer.

Referring now to FIG. 5 which illustrates a possible embodiment of an admission for the water to be filtered coming from the swimming pool that will be sucked in by the flow multiplier of this invention.

According to the embodiment shown in the drawing, the wall 34 of the pool holds the water in the swimming pool up to the level indicated in 35. Through the upper part of the wall 34 is provided an opening 36 that opens in a standard way behind the wall 34 into a set-back volume 37 that receives, as shown by the arrow, the water admitted via the opening 36, designed with a standard articulated door 48. Said volume 37 is also designed with a standard basket 38 capable of holding substantial floating debris, such as leaves for instance. The water thus rid of these debris is usually recycled to the pump 10 via a tubing such as 22 illustrated in FIGS. 1 and 2.

According to this invention, under the basket 38 the volume 37 is extended over the length suitable to house a filter 39, e.g. of the cartridge type. The water, rid of its biggest debris that were skimmed off the pool surface and held in the basket 38, goes through the filter 39 and comes out filtered at its base through a tubing 40, of suitable section and profile [not shown here, but which will be calculated as a function of the traffic flows in particular]; said tubing 40 is connected to the entrance of the flow multiplier 30 of this invention. This device operates, as will be detailed thereafter in reference to FIG. 7, by being fed by an annular admission ring located at the junction of the device tuyeres, convergent and divergent respectively, said admission ring receiving the return flow from the pump 10 via the tubing 29. At the exit of the device 30, the total sum of the water flow sucked through the skimmer and of the return water flow coming from the pump via the tubing 29 is found in the exit line 32 to be directed, as illustrated in FIG. 3, 4 or 6, to the return nozzle 33, or to the return nozzles 27, 28.

Figure 7:
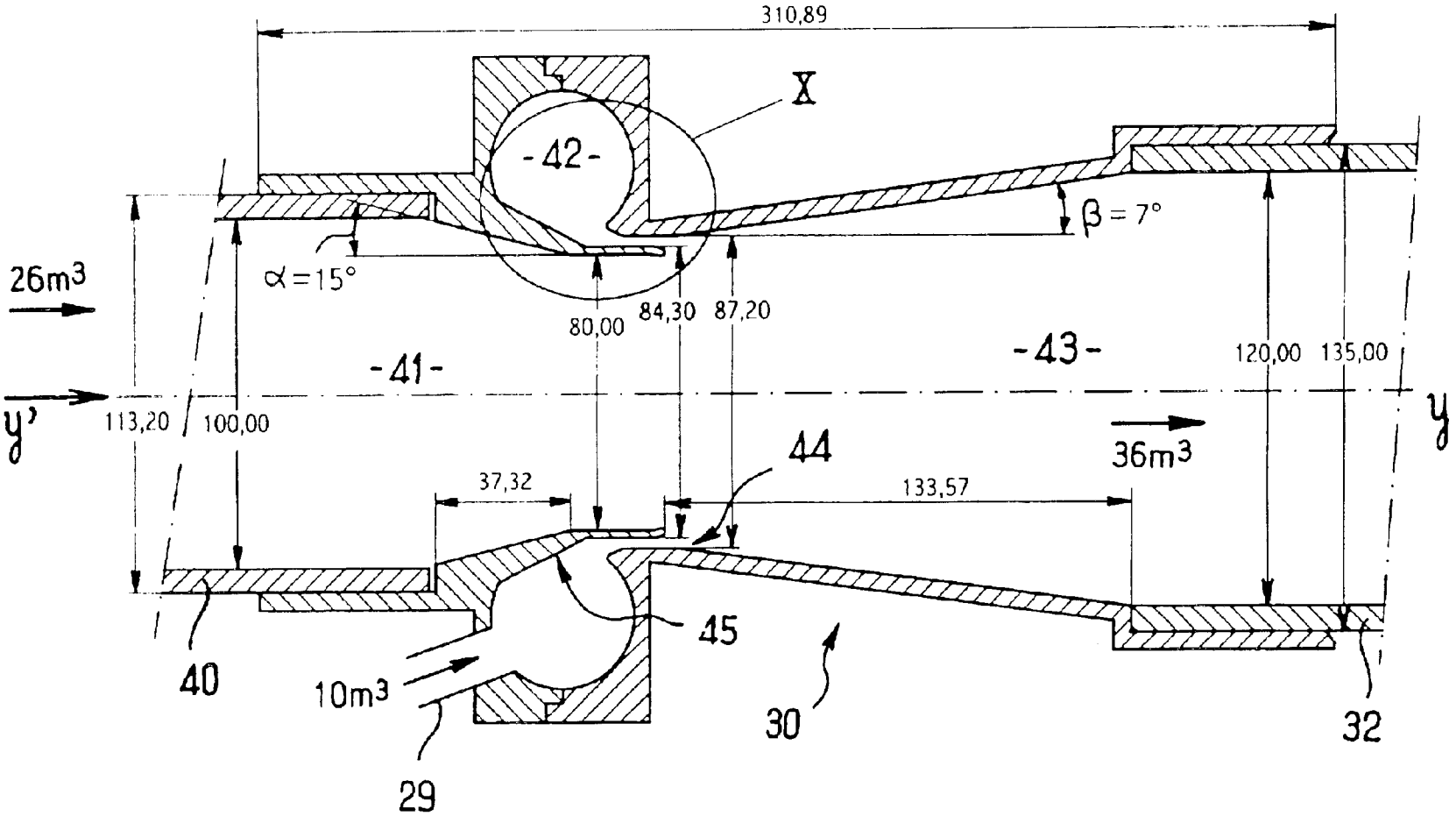
FIG. 7 is a longitudinal section of a flow multiplier designed according to this invention.
Figure 8:
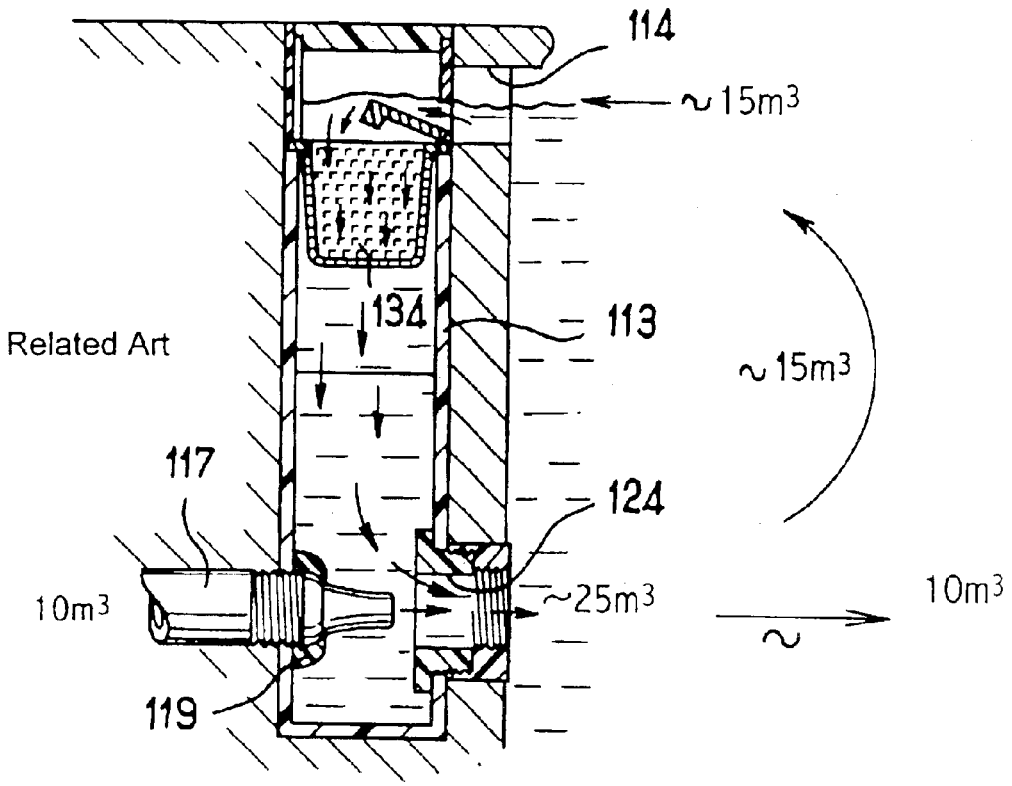
FIG. 8 is a cross-section view, as is FIG. 5, of an already-known equipement.
Figure 9:
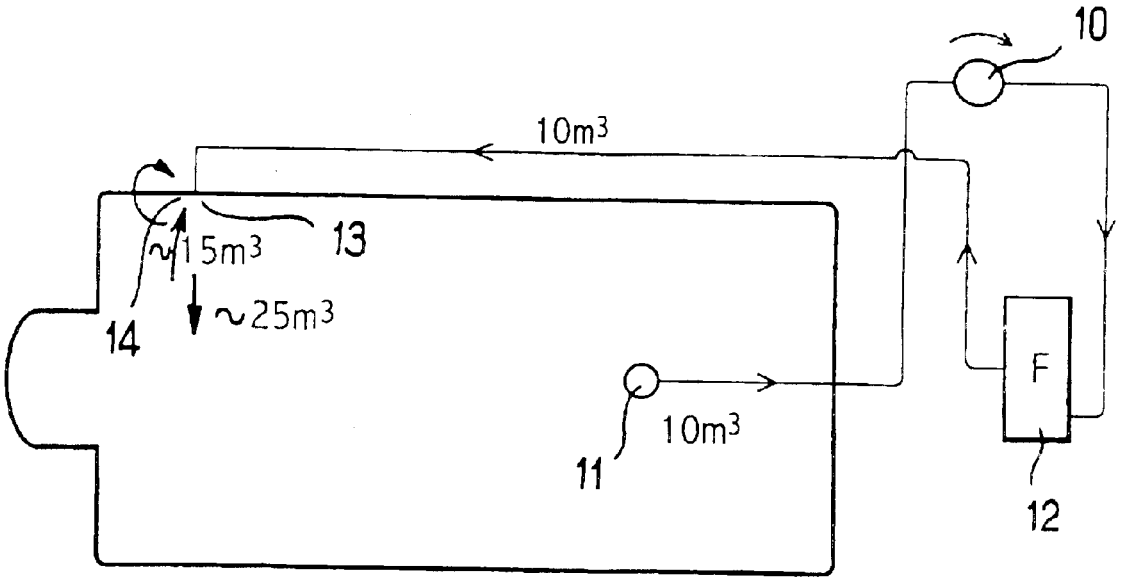
Related Art FIG. 9
FIG. 9 is a top view of the pool equipped with a filtration and circulation circuit using the device of FIG. 8.

Reference will be made now to FIG. 7 illustrating a water flow multiplier of this invention.

The device shown as a whole in 30 consists essentially, as previously mentioned, of a convergent tuyere 41 for the water admission, extended by a divergent tuyere 43 for the water return, said tuyeres being connected in their narrower portion by communicating with an annular ring 42 via a slit 44 oriented parallel to the axis yy' of the device and toward the upstream, i.e. in the yy' direction.

As previously mentioned, the return water from the circulation pump 10 comes via a tubing 29 into the volume of the annular ring 42. This water injection in the annular ring 42 generates, because of the orientation of the slit 44, a suction of the water into the admission convergent tuyere 41 and its acceleration as it escapes through the divergent tuyere 43. It is to be noted that the annular ring 42 is designed with an essentially circular cross-section, except for an inner area 45 that connects, by an inclined plan under an obtuse angle, with the slit 44.

The convergence angle $\alpha$ of the tuyere 41 is advantageously about 15 degrees, while the divergence angle $\beta$ of the tuyere 43 is advantageously about 7 degrees.

As shown in the drawing, for convenience purposes, the ring for the water supply coming from the pump and both tuyeres are advantageously made of a plastic molding in two parts connected along a median mating plane of the ring. Each part can itself be made of two symmetrical longitudinal halves joined along a longitudinal median mating plane. Each end of the convergent tuyere and of the divergent tuyere is provided with shoulders on which are connected the respective tubulures designed with a constant diameter, i.e. the tubulure 40 receiving the water from the filter 39 et the tubulure 32 that returns the water to the pool.

Figure 10:
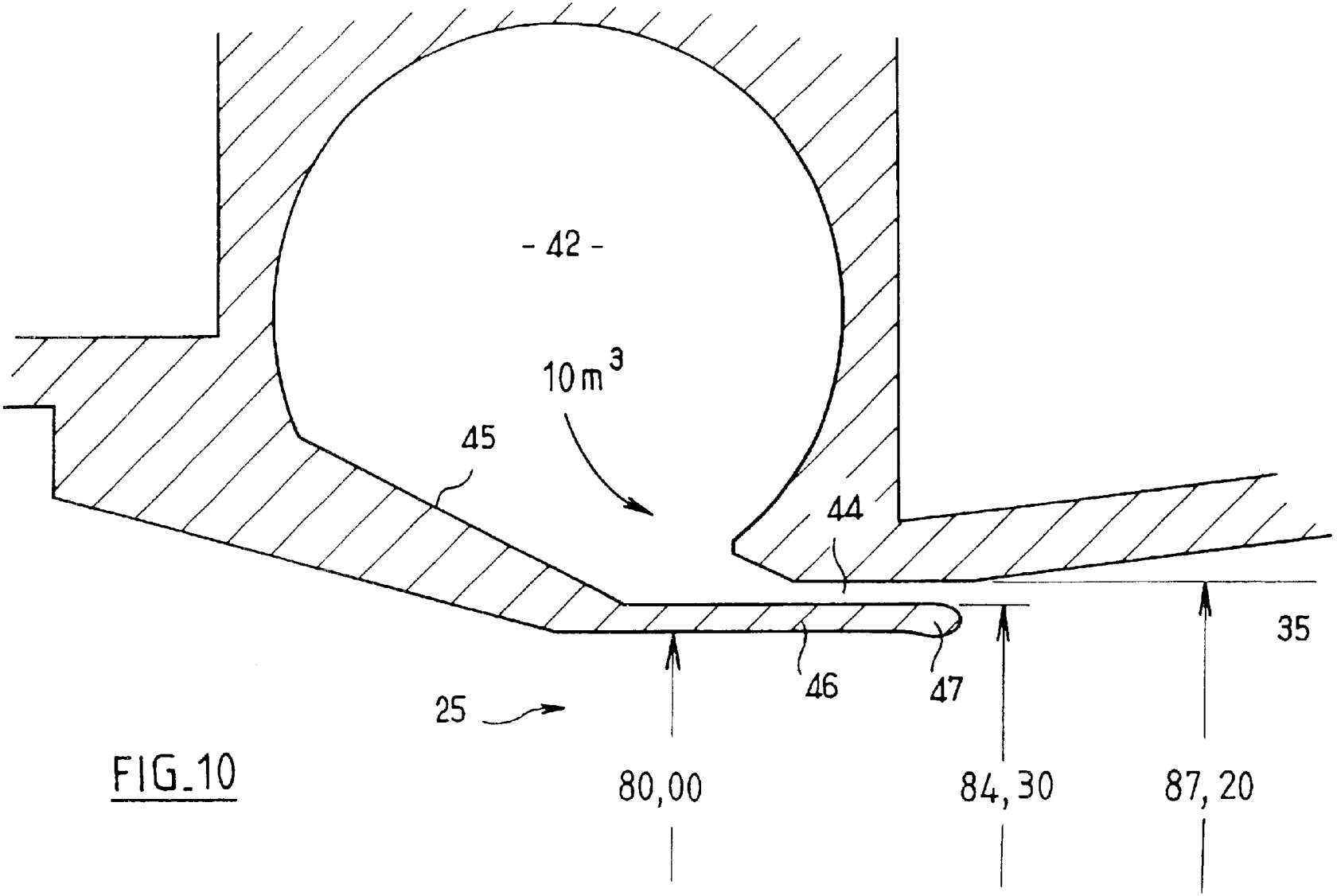
FIG. 10 shows enlarged the detail X circled in FIG. 7.

The quoted values on the drawing shows dimensions that were proven entirely satisfactory under the conditions indicated for the flow of the circulation pump and for the diameter of said tubulures. The values recorded here are 100 mm for the inner diameter of the tubulure 40, 120 mm for the inner diameter of the tubulure 43, 37.32 mm for the length of the convergent tuyere 41 proper, 133.57 mm for the length of the divergent tuyere proper, 80 mm for the inner diameter at the level of the inner side of the wall of the slit and 84.30 mm at the level of the outer side of the wall of the slit, said slit being about 1.45-mm wide ([87.20–84.30]/2). It is also to be noted that the end 47 of the wall 46 of the slit 44 (see in particular FIG. 10) is slightly rounded and oriented toward the inside for a maximum efficiency of the multiplier. Such design enabled to obtain, when the return pump was sending in the volume of the annular ring 42 a 10-$m^3$ flow, a sucking flow with a constant 26 $m^3$-rate through the entrance 41 and, consequently, a 36-$m^3$ discharge flow though the tubulure 32.

More generally speaking, the dimensions of the flow multiplier will be a function of the desired flows, and it will be possible to adjust the device, by simple homothetic transformation, to greater or smaller flows.

This invention is definitely advantageous in that its application allows a great flexibility of use, particularly regarding the distribution of the suctions and returns around the pool. For instance, particularly in the case of a collective swimming pool, it is possible to set on the pool edge filtered suctions at one end and returns at the opposite end, thus creating a river effect on the water surface.

Although it was stated earlier that the filter was "suitably" set upstream from the intake of the water admitted in the flow multiplier, it appears that the filter could be set elsewhere on the multiplied water circuit, even though the recommended upstream installation seems generally preferable.

Likewise, the drawings show the standard filter 12 set downstream from the circulating pump; yet, its location could be different, the filter could even be taken out altogether.

What is claimed is:

1. Filtration process for swimming pools, at least a portion of a return water flow of a circulation pump being sent in at least one flow multiplier comprising a convergent tuyere followed by a divergent tuyere with, at an intermediary location, an admission of said return water flow of which the entrance on a side of the convergent tuyere communicates with at least one admission of the water to be filtered coming from the swimming pool and that goes through a filter set upstream from said entrance, and of which an exit on a side of the divergent tuyere opens to the pool, the admission for said water to be filtered being formed by a mouth of a skimmer, wherein the filter set upstream from the entrance of the convergent tuyere is located right under a basket set at the entrance of said skimmer.

2. Process according to claim 1, wherein the exit on the side of the divergent tuyere is connected to several returns distributed in the pool to ensure the best water circulation.

3. Swimming pool equipped with a filtration system designed according to the process of claim 2.

4. Water flow multiplier for filtration process for swimming pools, wherein at least a portion of a return water flow of a circulation pump is sent in at least one flow multiplier, said multiplier comprising:

on a suction side a convergent tuyere, on a return side a divergent tuyere, at a neck situated between the divergent tuyere and the convergent tuyeres a ring around a narrower section, in which ring is brought the at least a portion of return water of the circulation pump, said ring leading via an annular slit to a beginning of the divergent tuyere.

5. Swimming pool equipped with a flow multiplier according to claim 4.

6. Water flow multiplier according to claim 4, wherein the convergent tuyere is set at an angle of about 15 degrees and the divergent tuyere is set at an angle of about 7 degrees.

7. Swimming pool equipped with a flow multiplier according to claim 6.

8. Water flow multiplier according to claim 6, wherein the ring has a section essentially circular except on an inner part where it connects by an inclined plane under an obtuse angle with the annular slit for the water injection.

9. Swimming pool equipped with a flow multiplier according to claim 8.

* * * * *